US009675137B2

(12) United States Patent
Wu

(10) Patent No.: US 9,675,137 B2
(45) Date of Patent: Jun. 13, 2017

(54) ELASTIC CORELESS ROPE BELT

(71) Applicant: Steve Wu, Changhua Hsien (TW)

(72) Inventor: Steve Wu, Changhua Hsien (TW)

( * ) Notice: Subject to any disclaimer, the term of this patent is extended or adjusted under 35 U.S.C. 154(b) by 0 days.

(21) Appl. No.: 14/848,259

(22) Filed: Sep. 8, 2015

(65) Prior Publication Data

US 2017/0065026 A1 Mar. 9, 2017

(51) Int. Cl.

| | |
|---|---|
| ***A43C 1/02*** | (2006.01) |
| ***A43C 7/00*** | (2006.01) |
| ***A43C 9/00*** | (2006.01) |

(52) U.S. Cl.

CPC ..... *A43C 1/02* (2013.01); *A43C 7/00* (2013.01); *A43C 9/00* (2013.01); *Y10T 24/3787* (2015.01)

(58) Field of Classification Search

CPC .... A43C 1/02; A43C 9/00; A43C 7/00; Y10T 24/3787

See application file for complete search history.

(56) References Cited

U.S. PATENT DOCUMENTS

| | | | | |
|---|---|---|---|---|
| 5,388,315 | A * | 2/1995 | Jones | A43B 3/0078 24/712.1 |
| 6,202,263 | B1 * | 3/2001 | Harker | B62J 7/08 114/230.2 |
| 6,513,210 | B1 * | 2/2003 | Gonzalez | A43C 1/00 24/300 |
| 7,549,201 | B2 * | 6/2009 | Kraft | A43C 1/02 24/713 |
| 8,832,913 | B2 * | 9/2014 | Kajiwara | A43C 9/00 24/715.3 |
| 2012/0232655 | A1 * | 9/2012 | Lorrison | A61F 2/0045 623/13.19 |
| 2013/0255045 | A1 * | 10/2013 | Gonzalez | A43C 9/00 24/715.3 |
| 2014/0007392 | A1 * | 1/2014 | Kajiwara | A43C 9/00 24/715.3 |

FOREIGN PATENT DOCUMENTS

| | | | | |
|---|---|---|---|---|
| FR | 2971676 | A1 * | 8/2012 | A43C 1/02 |

* cited by examiner

*Primary Examiner* — Robert J Sandy
(74) *Attorney, Agent, or Firm* — Guice Patents PLLC

(57) ABSTRACT

An elastic coreless rope belt is a tubular braided rope of no core with stretch elasticity. Wherein the center part of the elastic rope belt along its length keep the same hollow shape, and at the periphery of the rope, it is provided with protruded knot parts of plural middle segment. At the plural middle segment, the diameter of the protruded knot can be changed with the changing of the axial tension. Once the axial tension is relived, the diameter and the shape will return to the origin. Thereby, it is convenient to make position limited buckling and loosening to the object hole.

9 Claims, 5 Drawing Sheets

ELASTIC CORELESS ROPE BELT

BACKGROUND OF THE INVENTION a) Field of the Invention

This invention concerns an elastic coreless rope belt, especially referring to such applied to the eyelet of a punched object for position limited buckling and loosening. The objects include shoes, clothing, hats, bags and belts, etc, which require regular buckling or loosening. By setting knots at the protruded knot part of the elastic rope belt, it is convenient to make position limited buckling and loosening to the object hole.

b) Description of the Prior Art

In our daily life, for some objects as shoes, clothing, hats, bags and belts, etc., usually a rope belt is used for regular buckling or loosening. This is common and widely applied. In the practice, openings or holes punched will be usually reserved for the rope belt passing, and then the two ends of it will be knotted to be fixed and combined. However, in this way of knotting, it is inconvenient to make buckling or loosening. As a result, a so called elastic rope belt (or elastic rope) is invented. The relevant techniques could be referred to patent cases as US 2013/0255045 A1 (same case of patent application CN 104486961 A), JP 5079926 B1 (same case of patent application TW I 491781), etc.

In patent case of US 2013/0255045 A1, the said elastic rope belt contains an elastic core, and a soft noose around it. The elastic rope belt has conical protruded parts of plural segment. For example, in the implementing case of the holes of shoes, with the existing technique, the elasticity is limited as the soft noose is not made of elastic material, which will restrict the stretch range of the elastic rope core. Meanwhile, the core itself has both strong elasticity of dynamic part and hardly elasticity of static part, leading to a large deformation accumulated at its boundary areas, and causing problems of easily crack of the elastic rope belt.

In patent case of JP 5079926 B1, the said elastic rope 1 structure (as FIG. 1) contains a tubular rope 12 body of elastic material, and a center rope 11 of non elastic material. The tubular rope 12 has rope knots 121 of plural segment. The rope knots 121 corresponding to the center rope 11 part, are provided with coil part 111. In order to accommodate the coil part 111, an indent spacing 122 is set accordingly at the inside face of the rope knot 121; When this structure is implemented in threading holes of the shoes in tying, as pressed by the protruded part of coil part 111 of the center rope 11, the stretch range of the rope knot 121 of the tubular rope 12 should be restricted, resulting in no elastic spacing for rope knot 121.

Therefore, when the rope knot 121 touches the navicular bone, cuneiform bone, and articulation of metatarsal bone, an uncomfortable feeling will be caused by pressing.

As mentioned above, in existing technique, the known elastic rope belt (or elastic rope) has a Center rope (also called rope core, and center core). The Center rope will trap the external elastic range of the elastic rope belt. Furthermore, currently the elastic rope in production is knitted at conveying speed in scaling. As a result, the elasticity cannot be released fully, and the use of the elastic rope is also limited.

SUMMARY OF THE INVENTION

Thereby the inventor of this patent case finally invents the elastic coreless rope belt after countless times of research and improving. The purpose of this invention is to make an elastic coreless rope belt uneasy to crack and of better elasticity. With the knot provided at the protruded knot part of the elastic rope belt, it is convenient to make position limited buckling and loosening to the holes of the objects. To reach the purpose of this invention, the invented elastic coreless rope belt, is a tubular braided coreless rope belt, with elasticity, wherein:

The center parts of the elastic rope along its length keep the same hollow shape, and at the periphery of the rope, it is provided with protruded knot part of plural segment in the middle at interval along its length. The protruded knot part is of strong elasticity. The protruded diameter of the protruded knot part is bigger than the diameter of the eyelet of the object. The diameter of the protruded knot part can be changed with the changing of the axial tension. The minimum diameter of the protruded knot part with the axial tension should be smaller than the eyelet size of the object. Once the axial tension is relived, the diameter will return to the origin. Hereby, it is convenient to make position limited buckling and loosening to the object.

The configuration of the above protruded knot part and the middle part is repeatedly provided adjacently at interval on the elastic rope. Middle part of the above, is the part of little elasticity. The base diameter of it can pass the eyelet of the object freely with no axial tension.

Each part of the above elastic rope belt is distributed for different braiding density. The braiding density of the protruded knot part is higher than that of the middle part, resulting in the formation of the protruded part of the protruded diameter.

The shape of the above protruded knot part is of symmetrical.

The shape of the above protruded knot part is of unsymmetrical.

The above protruded knot part is configured with mixed arrangement, composing of more than two different protruded shapes.

The braiding length of above protruded knot part, is of strong elasticity under the axial force, whose length stretched outward depends on actual needs, with up to a maximum of 3~5 times of the original length of knitting length.

The above elastic rope belt, is made of elastic material, which is made from natural rubber, synthetic rubber, poly methyl ether glycol, mixing or weaving fibers.

The above elastic rope belt is hybrid braided with material of elasticity and non elasticity in a certain mixed proportion.

DETAILED DESCRIPTION OF THE INVENTION

Figure 1:
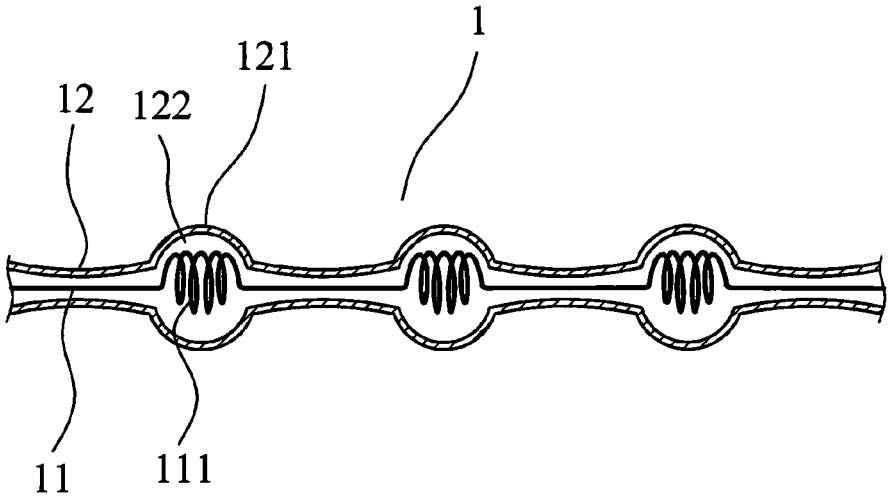
FIG. 1 PRIOR ART
FIG. 1 Diagrammatic cross-section of prior art
Figure 2:
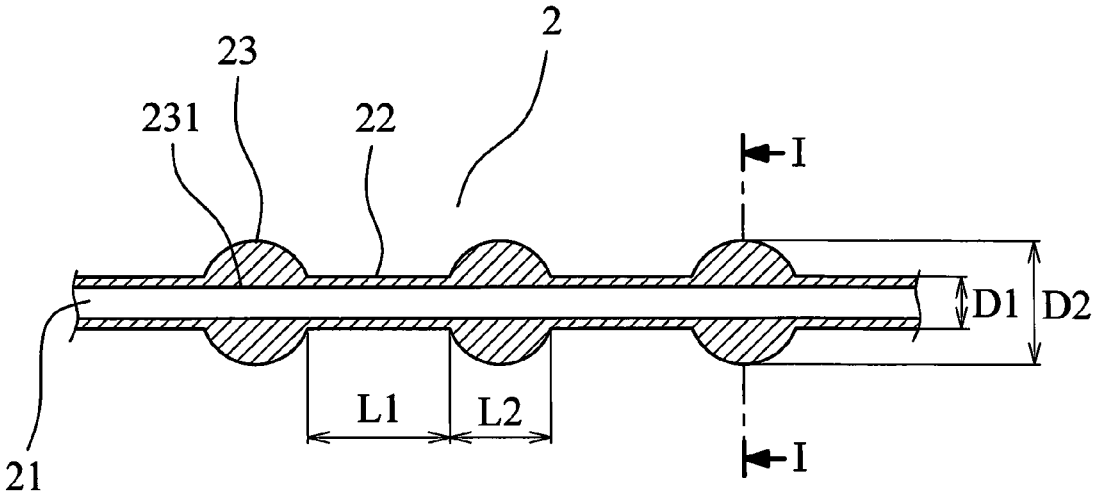
FIG. 2 Diagrammatic cross-section of the invention
Figure 3:
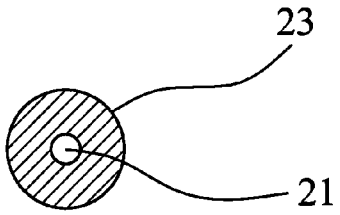
FIG. 3 I-I diagrammatic cross-section of FIG. 2 of the invention
Figure 4:
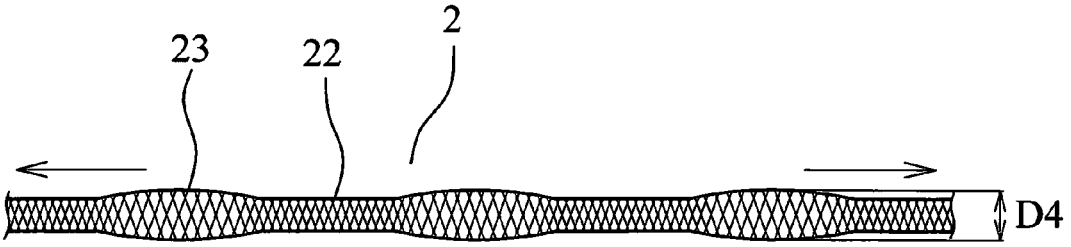
FIG. 4 External view of the invention under stress in tensile
Figure 5:
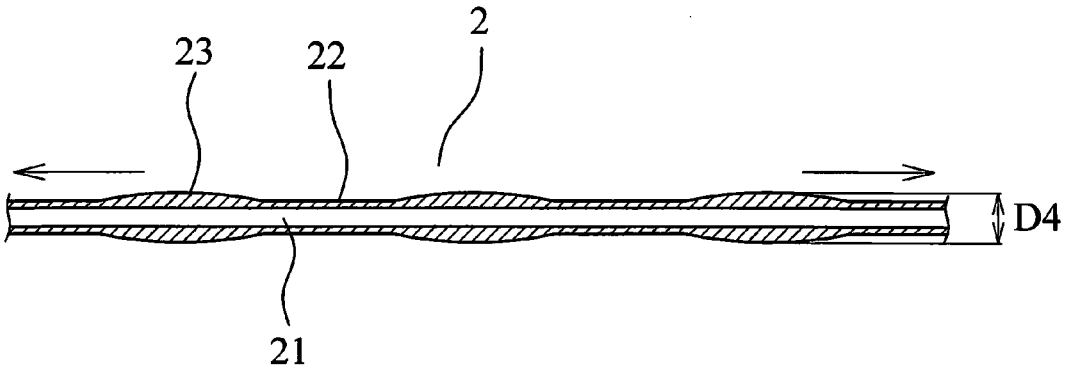
FIG. 5 Diagrammatic cross-section of the invention under stress in tensile
Figure 6:
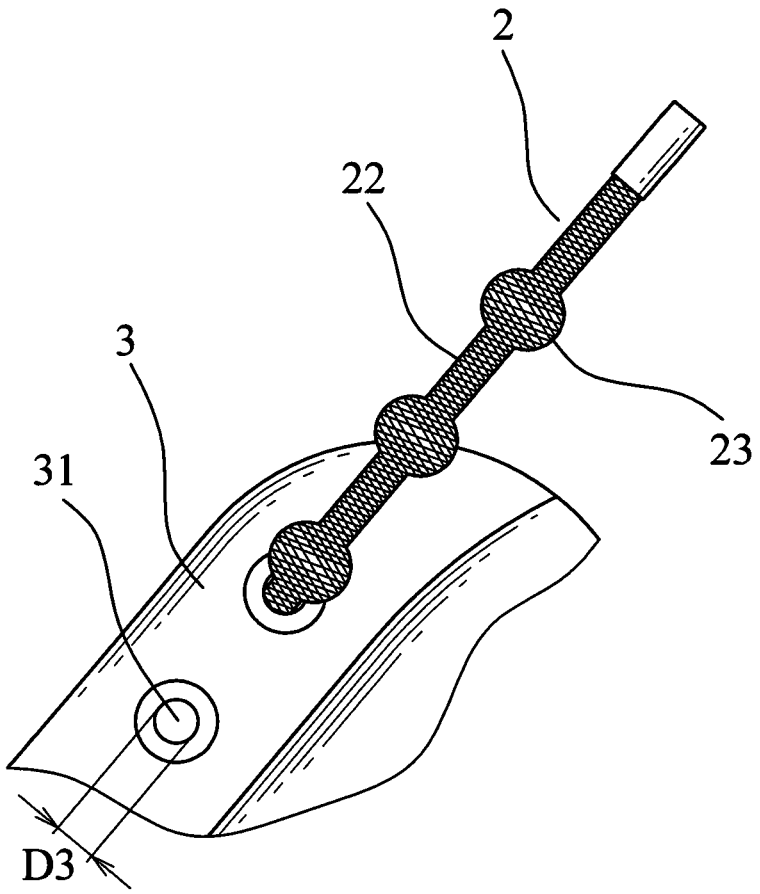
FIG. 6 Schematic diagram of three-dimensional implementing case of the invention FIG. 7 Diagrammatic cross-section of implementing case (1) of the invention FIG. 8 Diagrammatic cross-section of implementing case (2) of the invention FIG. 9 Diagrammatic cross-section of implementing case (3) of the invention FIG. 10 Diagrammatic cross-section of implementing case (4) of the invention FIG. 11 Schematic diagram (1) of curvilinear relationship of the invention FIG. 12 Schematic diagram (2) of curvilinear relationship of the invention FIG. 13 Schematic diagram (3) of curvilinear relationship of the invention

Please refer to FIG. 2 to FIG. 6, elastic rope belt 2 of this invention is an elastic coreless tubulose braided rope belt, in which the center part 21 of this elastic rope belt 2 keeps same hollow shape along its length, and plural protruded knot part 23 and plural middle segment 22 will be alternately configured outside the elastic rope belt along its length, the protruded knot part 23 is the part flexing fiercely, the protruded knot diameter D2 of the protruded knot part 23 is larger than aperture D2 of hole 31 on material 3, and the diameter of protruded knot diameter D2 will change with axial tension, the minimal diameter D4 of protruded knot part 23 which can bear axial force is less than aperture D3 of hole 31 of its object, and returns to original protruded knot diameter D2 and shape after the axial force is relieved, the middle segment 22 is the part which flexes not fiercely, the basic diameter D1 of middle segment 22 can pass through aperture D3 of hole 31 of its object with no axial force, and make up via this structure, making it convenient for object 3 to grip and release.

The protruded knot part 23 and middle segment 22 in this invention are alternately configured in elastic rope belt 2, and change the protruded knot diameter D2 of protruded knot according to axial tension.

Figure 7:
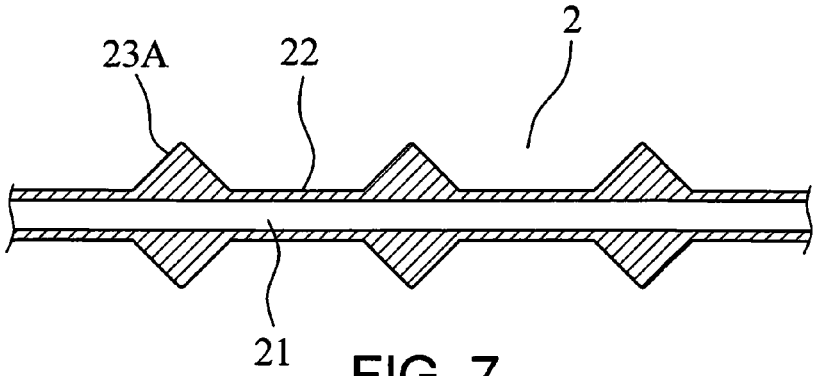
Figure 8:
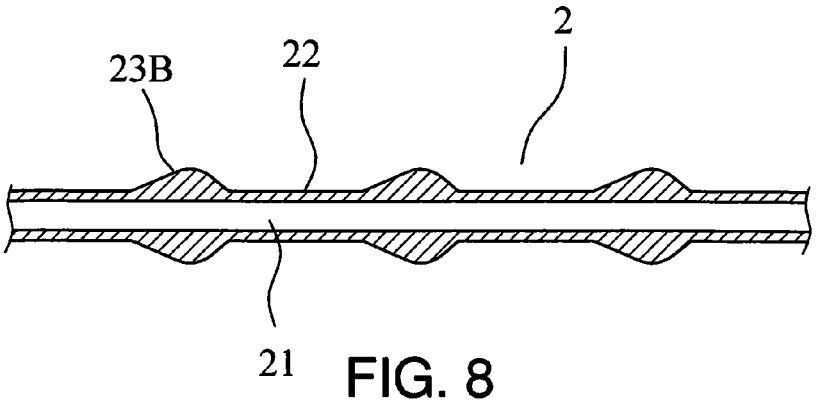
Figure 9:
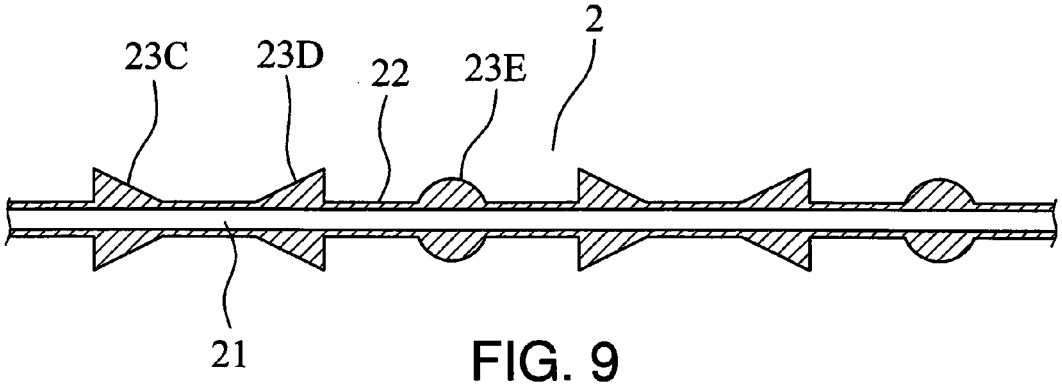
Figure 10:
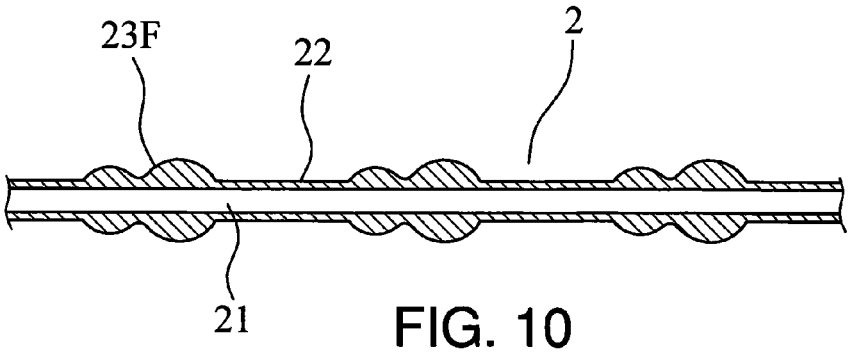
Figure 11:
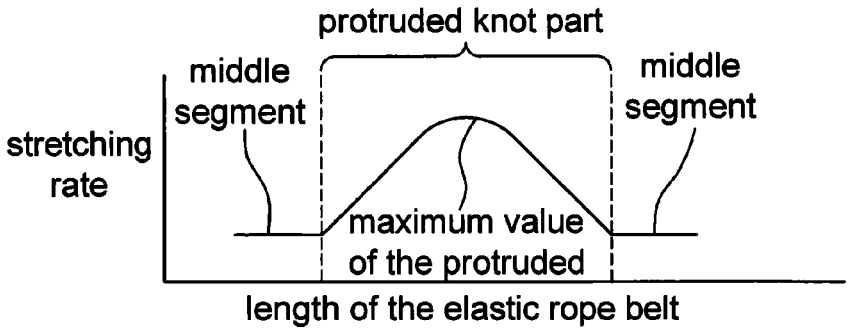
Figure 12:
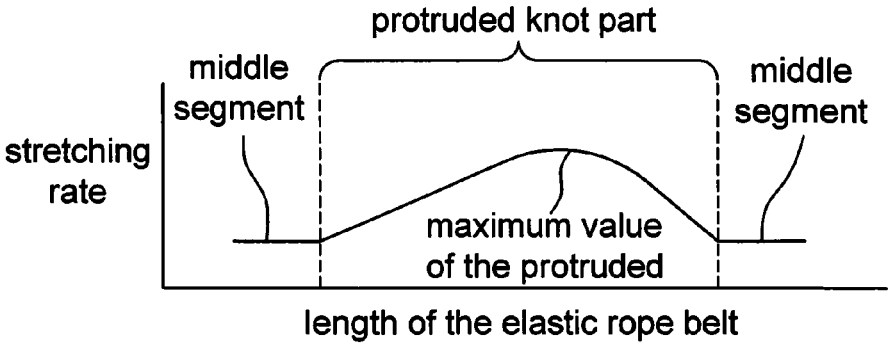
Figure 13:
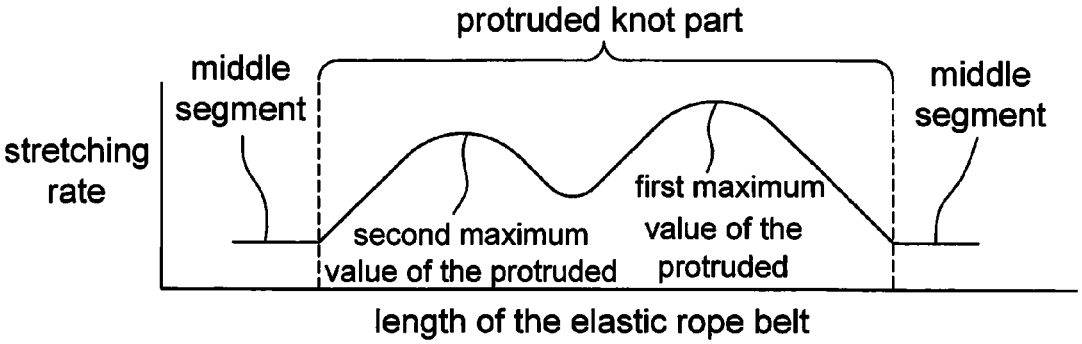

The elastic rope belt 2 of this invention, its so-called protruded knot part 23 means the cord is compared to the basic diameter D1 of the middle segment 22 with no axial tension, and has part with protruded knot diameter D2; the weaving mode of elastic rope belt 2 executes transportation speed with variable proportion, making the weaving density distributing on every point of protruded knot part 23, which is to control the stretching rate of each point on protruded knot part 23 with different weaving density ratio, making the weaving density of protruded knot part 23 higher than that of middle segment 22, and forming a protruded knot part and shape with that protruded knot diameter; the protruded knot part 23 can be in any shape, and protruded knot part 23 can be divided into symmetry, non-symmetry and mixed type according to its shape, in which the shape of symmetry type can be the protruded knot part 23A (as shown in FIG. 7) of corniform, protruded knot part 23B (as shown in FIG. 8) of circular arc, the part with higher stretching rate has higher weaving density; it can be known from the curvilinear relationship in FIG. 11, that the maximal part of protruded knot part 23 is the part of protruded knot diameter D2, uniformly distributing on both sides of it, and the shape corresponding to protruded knot part 23 distributes likewise; the shape of non-symmetry type can be protruded knot part 23B (as shown in FIG. 8) of a circular arc; it can be known from the curvilinear relationship in FIG. 12, that the maximal part of protruded knot part 23 is the part of protruded knot diameter D2, but not in the middle, not uniformly distributing on both sides of it; the shape of mixed type arranges along the elastic rope belt 2, including over 2 protruded knots of 23C, 23D, 23E, 23F (as shown in FIGS. 9 and 10) in different shapes; these protruded knots have a same feature, that the protruded knot diameter D2 is larger than aperture D3 of hole 31 of its object, which enables protruded knot part 23C, 23D, 23E, 23F form limit clamp to hole 31, when relieving clamp, stretching the elastic rope belt 2 toward one end or two ends, to make protruded knot part 23, 23A, 23B, 23C, 23D, 23F distorting along axis; when the minimal diameter D4 is less than aperture D3 of hole 31 of object 3, the protruded knot part 23, 23A, 23B, 23C, 23D, 23F can pass through hole 31, making it convenient to limit clamp and relieve clamp; when the axial tension is relieved, the protruded knot part 23, 23A, 23B, 23C, 23D, 23F will return to the original protruded knot diameter D2 and shape; taking FIG. 10 as an example, the protruded knot part 23F has a big protruded knot part and a small one, and it can be known from the curvilinear relationship in FIG. 13 that the protruded knot part also presents the relation between maximal protruded knot value.

Relatively, the weaving length L1 (please refer to FIG. 2) of the middle segment 22 is the part which flexes not fiercely when bearing axial force; the weaving length L2 of the protruded knot part 23 is the part which flexes fiercely when bearing axial force; the length it can stretch depends on the use demand, and reach a maximum weaving length of 3~5 times of weaving length L2.

The elastic rope belt 2 of this invention is an elastic coreless tubulose braided rope belt, whose material is chosen from natural rubber, synthetic rubber, polytetramethylene ether glycol, mixed or weaved fiber (including nylon fiber, polyester fiber), the elastic rope belt 2 can be weaved into a coreless tubulose braided rope belt, it can also mixed weaved into elastic rope belt 2 with elastic or inelastic material according to certain ratio.

The elastic rope belt 2 of this invention is a coreless tubulose braided rope belt, in which the center part 21 keeps same hollow shape along its length, and its advantage is the elastic rope belt 2 can keep its shape unchanged depending on its elastic supporting feature when it's not bearing force, there is enough storage and flexing space between the internal side 231 of protruded knot part 23 and the center part 21, so when punching a hole on the shoe, there is no limit of traditional-style central rope core, and the protruded knot part 23 has more elasticity, which won't generate pressure on the navicular bone, sphenoid bone and articulations of metatarsal bones, and make the wearer feel comfortable.

What is claimed is:

1. A coreless elastic rope belt for use with a material having at least one aperture, the coreless elastic rope belt comprising:

an elastic rope being an elastic coreless tubulose braided rope belt;

wherein, a center part of the elastic rope has a uniform hollow shape along a length thereof, and a plurality of protruded knots and a plurality of middle segments are alternatively positioned on an outside of the elastic rope along a length thereof, the plurality of protruded knots are flexible, each knot of the plurality of protruded knots has a protruded knot diameter that is larger than a diameter of the at least one aperture in the material;

wherein, when an axial tension is applied to stretch the length of the elastic rope, the protruded knot diameter of the each said knot of the plurality of protruded knots becomes a minimal diameter and the minimal diameter of each said knot of the plurality of protruded knots is smaller than the diameter of the at least one aperture in the material; and wherein, when the axial tension is removed from the elastic rope, a diameter of each knot of the plurality of protruded knots returns to an original protruded knot diameter;

wherein the elastic rope belt is mixed weaved with an elastic material according to a predetermined weaving density ratio.

2. The coreless elastic rope belt according to claim 1, wherein the plurality of protruded knots and the plurality of middle segments of the coreless elastic rope belt are alternately configured along the elastic rope belt.

3. The coreless elastic rope belt according to claim 1, wherein the plurality of middle segments of the coreless elastic rope belt are less flexible than the plurality of protruded knots, and each middle segment the plurality of middle segments has a diameter that is smaller than the diameter of the at least one aperture in the material.

4. The coreless elastic rope belt according to claim 1, wherein each said knot of the plurality of protruded knots has a weaving density that is higher than a weaving density of each middle segment of the plurality of middle segments thereby forming the plurality of protruded knots.

5. The coreless elastic rope belt according to claim 1, wherein each said knot of the plurality of protruded knots has a shape on the coreless elastic rope belt that is symmetrical.

6. The coreless elastic rope belt according to claim 1, wherein each said knot of the plurality of protruded knots has a shape on the coreless elastic rope belt that is non-symmetrical.

7. The coreless elastic rope belt according to claim 1, wherein the plurality of protruded knots of the coreless elastic rope belt includes a mixture of symmetrical and non-symmetrical shapes, including the plurality of protruded knots consisting of over 2 different protruded knot shapes.

8. The coreless elastic rope belt according to claim 1, wherein a weaving length of each said protruded knot is flexible, when the axial tension is applied, the weaving length of each said protruded knot is stretchable to a maximum weaving length of 3~5 times an original weaving length.

9. The coreless elastic rope belt according to claim 1, wherein the elastic rope belt consists of an elastic material, which is chosen from natural rubber, synthetic rubber, polytetramethylene ether glycol, mixed or weaved fiber.

* * * * *